US006612093B1

(12) United States Patent
Grossmann et al.

(10) Patent No.: US 6,612,093 B1
(45) Date of Patent: Sep. 2, 2003

(54) METHOD OF AND APPARATUS FOR MAKING PACKETS FOR ARRAYS OF DISCRETE COMMODITIES

(75) Inventors: Jürgen Grossmann, Wentorf (DE); Hartmut Meis, Hamburg (DE)

(73) Assignee: Topack Verpackungstechnik GmbH, Schwarzenbek (DE)

( * ) Notice: Subject to any disclaimer, the term of this patent is extended or adjusted under 35 U.S.C. 154(b) by 245 days.

(21) Appl. No.: 09/678,671

(22) Filed: Oct. 4, 2000

(30) Foreign Application Priority Data

Oct. 4, 1999 (DE) ..... 199 47 709

(51) Int. Cl.[7] ..... B65B 57/00

(52) U.S. Cl. ..... 53/56; 53/493; 53/148; 53/236

(58) Field of Search ..... 53/148, 228, 234, 53/236, 56, 534, 133.5, 133.8, 493, 494; 493/130, 132, 162, 180

(56) References Cited

U.S. PATENT DOCUMENTS

| | | | | |
|---|---|---|---|---|
| 2,931,487 A | | 4/1960 | Frank et al. | |
| 3,735,767 A | * | 5/1973 | Kruse et al. | 53/148 |
| 3,805,477 A | * | 4/1974 | Kruse et al. | 53/234 |
| 3,911,645 A | * | 10/1975 | Schmermund | 53/234 |
| 3,922,837 A | * | 12/1975 | David | 53/148 |
| 3,924,386 A | * | 12/1975 | Schmermund | 53/234 |
| 3,956,870 A | * | 5/1976 | Kruse et al. | 53/234 |
| 4,004,395 A | * | 1/1977 | Bardenhagen et al. | 493/100 |
| 4,441,302 A | | 4/1984 | Gabbitas et al. | |
| 4,480,421 A | * | 11/1984 | Rece | 53/75 |
| 4,484,432 A | * | 11/1984 | Oberdorf | 53/234 |
| 4,607,477 A | * | 8/1986 | Hinchcliffe et al. | 53/148 |
| 4,673,381 A | * | 6/1987 | Yamamoto et al. | 493/132 |
| 4,999,967 A | | 3/1991 | Hoffman | |
| 5,133,173 A | | 7/1992 | Draghetti et al. | |
| 5,283,506 A | | 2/1994 | Hoffmann et al. | |
| 5,417,032 A | * | 5/1995 | Calvert et al. | 493/180 |
| 5,996,310 A | * | 12/1999 | Bailey et al. | 53/234 |

FOREIGN PATENT DOCUMENTS

| | | |
|---|---|---|
| DE | 2 115 505 | 12/1972 |
| DE | 26 50 684 | 5/1978 |
| DE | 30 28 946 | 2/1981 |
| DE | 38 00 432 | 7/1989 |
| DE | 41 09 713 | 10/1991 |
| DE | 42 16 824 | 12/1992 |
| DE | 196 52 210 | 6/1998 |
| EP | 0 963 913 | 12/1999 |
| GB | 1 575 125 A | 9/1980 |
| GB | 1 575 125 | 9/1980 |

* cited by examiner

*Primary Examiner*—John Sipos
*Assistant Examiner*—Louis Huynh
(74) *Attorney, Agent, or Firm*—Venable LLP; Robert Kinberg; Chad C. Anderson

(57) ABSTRACT

A cigarette packing machine has a first drive normally transmitting motion to packing units which are employed to advance a series of arrays of cigarettes or other rod-shaped articles of the tobacco processing industry and to confine each array in a discrete packet by providing each of successive arrays of the series with one or more envelopes, labels and the like. The first drive is decelerated and brought to a halt in the event of malfunctioning of one or more packing units of the machine and/or for other reasons, and this initiates or prevents an interruption of operation of at least one second drive which transmits motion to one or more packing units during deceleration and/or during a period following stoppage of the first drive. The second drive(s) causes or cause the respective packing unit(s) to complete operations which, if not carried out prior to restarting of the first drive, would entail the making of numerous defective packets.

20 Claims, 2 Drawing Sheets

METHOD OF AND APPARATUS FOR MAKING PACKETS FOR ARRAYS OF DISCRETE COMMODITIES

CROSS-REFERENCE TO RELATED CASES

This application claims the priority of commonly owned German patent application Serial No. 199 47 709.4 filed Oct. 4, 1999. The disclosure of the above-referenced German patent application, as well as that of each U.S. and foreign patent and patent application identified in the specification of the present application, is incorporated herein by reference.

BACKGROUND OF THE INVENTION

The invention relates to a method of and to an apparatus for packing discrete commodities, for example, commodities which constitute arrays of parallel rod-shaped articles (such as plain or filter cigarettes) of the tobacco processing industry. More particularly, the invention relates to improvements in methods of and in apparatus for packing arrays of cigarettes or the like wherein a drive is utilized to operate various units of the packing machine until the machine receives or generates a stop signal which initiates a stoppage of the drive.

An apparatus of the above outlined character is disclosed in published German patent application Serial No. 21 15 505 of Kruse et al. The apparatus comprises a first drive which advances a series of successive arrays of plain or filter cigarettes along an elongated path in stepwise fashion. Successive arrays receive blanks which are converted into envelopes surrounding the respective arrays. Each step of the method which can be carried out by resorting to such apparatus can begin while the array is in motion and can be completed during the immediately following interval of stillstand of the array. If the apparatus receives a signal which initiates a stoppage of the first drive, such signal does not entail immediate stoppage of all units which form part of the packing apparatus and participate in the making of successive finished packs each of which contains an array of rod-shaped articles. Instead, various units of the packing apparatus remain operational to thus ensure that certain packing or wrapping operations are completed before all units of the apparatus come to a standstill. This is desirable and advantageous because any prolonged stoppage of an array which is on its way along a path defined by a standard packing apparatus is likely to result in drying or setting of adhesive which is utilized to position various panels, walls, flaps, tucks and/or other foldable parts of successive converted blanks; therefore, the packets or envelopes constituted by such blanks are defective and must be discarded together with their contents.

Otherwise stated, the German patent application of Kruse et al. proposes to terminate various packing operations which must be completed without delay in order to turn out a satisfactory pack (such as a so-called soft pack or a so-called hinged-lid pack) which can be confined in a carton and/or otherwise processed rather than being dumped into a receptacle or onto a take-off conveyor for the gathering of defective packs.

The published German patent application of Kruse et al. further discloses that, in addition to the first drive (which serves to advance a series of successive arrays stepwise into and along a first path), the packing apparatus can employ a second drive which serves to supply blanks along a second path and into a selected portion of the; first path, as well as a third drive which is put to use subsequent to the generation of a stop signal and the ensuing stoppage of the first and/or second drive. The operations of such drives are regulated by a control circuit which ensures that the apparatus can complete a series of successive operations in order to achieve a reduction of the number of rejects. The control circuit is set up to ensure that the apparatus completes a series of treatments upon each constituent of a partly finished (future) pack so that the completion of partly finished packs can be carried out upon renewed starting of the drives.

A drawback of the aforediscussed conventional packing method and apparatus is that the number of rejects which are turned out during deceleration of the first drive and during operation of the second drive is still high or very high. Moreover, the aforediscussed prior proposal does not encompass the manipulation of all packing units which are likely to cause the making of unsatisfactory final products, such as packs of plain or filter cigarettes, cigars, cigarillos and/or other rod-shaped smokers' products. Furthermore, the control circuit which is proposed by Kruse et al. is rather complex and expensive.

OBJECTS OF THE INVENTION

An object of the present invention is to provide a method of packing arrays of cigarettes or the like or other types of commodities into envelopes of metallic foil, transparent plastic sheet stock, cardboard, paper and/or other wrapping materials in such a way that the number of rejects caused by a stoppage of the packing apparatus is well below that turned out by resorting to presently known methods.

Another object of the invention is to provide a method of reducing the cost of recovering tobacco from defective packs or boxes of plain or filter cigarettes or other smokers' products.

A further object of the invention is to provide a method which renders it possible to salvage partially finished packs of cigarettes or other rod-shaped smokers' products which are, being turned out or processed by a packing apparatus subsequent to the generation of a signal serving to initiate deceleration and eventual stoppage of the packing apparatus.

An additional object of the invention is to provide a method which renders it possible to reduce the number of rejects caused by decelerations and stoppages of a packing apparatus to a small fraction of the number of rejects being turned out under such circumstances by presently known packing apparatus including those disclosed in the published German patent application Serial No. 21 15 505.

An additional object of the invention is to provide a method which renders it possible to achieve substantial savings in metallic foil and/or other wrapping materials for arrays of rod-shaped smokers' products or other types of commodities.

Still another object of the invention is to provide a novel and improved packing apparatus for the practice of the above outlined method.

A further object of the invention is to provide a packing machine or apparatus with novel and improved means for driving various packing units including that or those serving to advance or transport arrays of rod-shaped smokers' products as well as those serving to supply and to manipulate blanks for conversion into envelopes or other constituents of packets for arrays of rod-shaped smokers' products.

Another object of the instant invention is to provide a packing machine or apparatus which can be utilized with equal advantage to achieve reductions in the numbers of defective packs or other types of containers for block-shaped commodities due to any and all known causes of deceleration and stoppage of a packing machine.

An additional object of the invention is to provide a packing machine or apparatus which exhibits the above-enumerated features and advantages and can be incorporated in presently known production lines for the making and processing of rod-shaped smokers' products as a superior substitute for presently known packing apparatus.

SUMMARY OF THE INVENTION

One feature of the present invention resides in the provision of a method of packing successive arrays of a series of arrays of rod-shaped articles of the tobacco processing industry. The improved method comprises the steps of employing at least one first drive to carry out a plurality of consecutive packing operations upon each of successive arrays of the series, generating at times (i.e., when necessary) signals each of which entails a deceleration and ensuing stoppage of the at least one first drive, and utilizing at least one second drive to carry out (at least in part) at least one of the packing operations during an interval covering at least one of (a) the deceleration, (b) the deceleration and a period of the ensuing stoppage, and (c) a period of the ensuing stoppage of the at least one first drive.

The packing operations can include the following steps: advancing successive arrays of the series along a predetermined path, and confining each array in at least one envelope in a predetermined portion of the path. The advancing step preferably comprises moving the arrays stepwise.

Alternatively, the packing operations can include the steps of advancing successive arrays of the series along a predetermined path, supplying to a portion of the predetermined path blanks for conversion into envelopes for successive arays, applying an adhesive to selected portions of the blanks, converting the blanks into envelopes surrounding the respective arrays, and withdrawing successive arrays and the respective blanks from the predetermined path. The converting step can include folding the blanks around the respective arrays.

The step of utilizing at least one second drive can include employing at least one differential gear.

The employing step can include resorting to a first drive which is arranged to rotate a first output element (such as a shaft) at a first RPM prior to the signal generating step, and the utilizing step can comprise utilizing at least one second drive which is arranged to rotate a second output element (e.g., a shaft) at a second RPM which at most matches the first RPM.

The method can further comprise the step of synchronizing the operation of the first drive with the operation of the at least one second drive.

Another feature of the present invention resides in the provision of a machine or apparatus for packing successive arrays of rod-shaped articles of the tobacco processing industry. The improved apparatus comprises a primary driving arrangement including at least one first drive, a plurality of mobile packing units which receive motion from the at least one first drive and are arranged to provide each of the series of arrays with at least one envelope, means for generating at times signals each of which entails a deceleration and ensuing stoppage of the at least one first drive, and a secondary driving arrangement including at least one second drive which is arranged to transmit motion to at least one of the packing units during an interval covering at least one of (a) the deceleration, (b) the deceleration and a period of ensuing stoppage, and (c) a period of ensuing stoppage of the first drive.

For example, the arrays can consist of quincunx formations of rod-shaped articles.

The improved, apparatus can further comprise means for separably coupling the at least one first drive with the at least one second drive.

The at least one second drive can comprise one or more differential, gears.

The at least one packing unit is or can be one of a plurality of, packing units including means for supplying to successive arrays of the series of arrays blanks for conversion into envelopes for the respective arrays, means for applying to selected portions of the blanks one or more, films of hotmelt or another suitable adhesive substance, means for converting blanks into envelopes, and means for evacuating packed arrays (i.e., finished packs).

If the at least one packing unit is one of a plurality of units including means for supplying to successive arrays of the series blanks for conversion into envelopes for the respective arrays, the secondary driving arrangement can comprise a plurality of second drives including a drive for the blank supplying means.

If the packing units include at least one means for supplying to successive arrays foldable blanks for conversion into envelopes for the respective arrays and folding means which is operable to drape the blanks around the respective arrays, the at least one second drive can include means for operating the folding means. Such folding means can include at least one rotary or otherwise movable folding member.

The at least one first drive can comprise at least one rotary first driving member which is rotatable at a plurality of different speeds, and the at least one second drive can comprise at least one second driving member which is rotatable at a plurality of different speeds; such packing apparatus can further comprise means for synchronizing the speed of the at least one first driving member with that of the at least one second driving member.

The improved packing apparatus can further comprise means for assembling rod-shaped articles into the aforementioned series of successive arrays.

The novel features which are considered as characteristic of the invention are set forth in particular in the appended claims. The improved packing apparatus itself, however, both as to its construction and the modes of assembling and operating the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
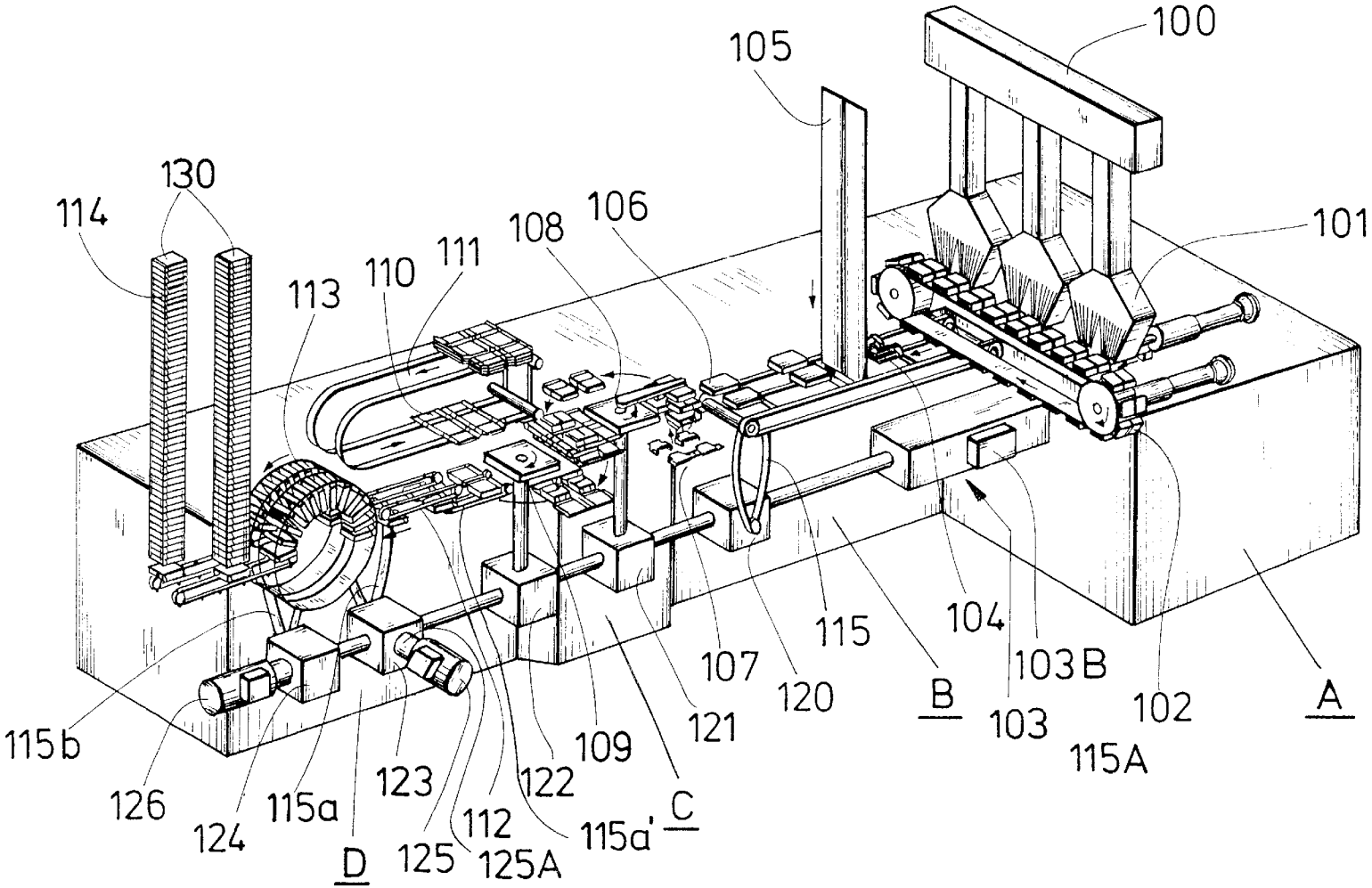
FIG. 1 is a partly schematic perspective view of a packing apparatus for arrays of plain or filter cigarettes which embodies one form of the present invention.

FIG. 1 shows a twin-track packing machine or apparatus for, the making of so-called hinged-lid packs 130 each of which is assumed to contain an array of 19 or 20 plain or filter cigarettes, cigars, cigarillos or other rod-shaped articles of the tobacco processing industry, e.g., in the so-called quincunx formation. The following part of this description will refer, for the sake of simplicity and convenience, to arrays of cigarettes; however, it is to be understood that the improved method can be practiced, and the improved apparatus can be utilized, with equal or similar advantage, for the packing of all or practically all types of rod-shaped smokers' products as well as for the packing of many other types of successive block-shaped commodities which are to be confined in single or plural envelopes made of paper, metallic foil, cardboard, transparent plastic sheet material or the like.

FIG. 1 shows only those constituents of the twin-track packing apparatus which are deemed to be necessary for a full understanding of all aspects of the present invention.

The reference character 100 denotes a unit which serves to assemble arrays of cigarettes in a manner well known in the art of cigarette packing machines. One presently known packing apparatus or machine which employs an assembling unit of the type shown at 100 is known as COMPAS 500 packer and is distributed by the assignee of the present application. The illustrated assembling unit 100 comprises three hoppers 101 which supply layers of cigarettes into the receptacles of an endless conveyor 102 serving to, advance empty receptacles into the range of the first hopper 101 which deposits therein a first layer of cigarettes, thereupon into the range of a second hopper which inserts a second layer of cigarettes so that the cigarettes of the second layer are parallel to but laterally offset relative to the cigarettes of the first layer, and thereafter into the range of the third hopper which delivers a third layer of cigarettes in such a way that the cigarettes of the third layer are parallel to the cigarettes of the first and second layers but are laterally offset relative to the cigarettes of the second layer. This completes the assembly of successive arrays which are thereupon delivered into two elongated paths at a transfer station 104 for stepwise advancement or transport past a series of packing units each of which carries out at least one of a series of operations necessary to provide each array with one or more envelopes and to thus form a series of finished hinged-lid packs The first packing unit 105 is designed to provide successive arrays in the two tracks with first or inner envelopes which can constitute converted blanks of a metallic foil, e.g., tinfoil. Each blank is draped around the respective array to constitute the outer envelope of a partially finished pack 106.

The next step includes advancement of successive partly finished packs 106 into the range of a second packing unit including one or more rotary and/or otherwise movable deforming or folding tools 108 for the application and deformation of preformed collars 107 of the type customary in hinged-lid packs.

A further packing unit includes a conveyor 111 which delivers a discrete second blank 110 (e.g., a cardboard blank) to a station where one or more rotary and/or otherwise movable folding tools 109 convert the second blanks 110 into outer envelopes each of which surrounds a partly finished pack 106 and the respective collar 107. Each second blank 110 which reaches the respective path for successive partly finished packs 106 must be provided with one or more films of a suitable adhesive coating those portions (such as walls, panels, flaps, tucks or the like) of the respective second blanks 110 which must be bonded to the adjacent walls, panels or like parts in order to advance or complete the making of finished packs 130. The adhesive can be a hotmelt and/or a cold-bonding glue. It is customary to apply adhesive films to the lateral flaps 112 of the blanks 110 so that such flaps are compelled to adhere to the adjacent sidewalls of the thus obtained outer envelopes.

The thus obtained converted partly finished packs 106 (each of which is partly surrounded by a collar 107 and is further surrounded by a partly converted cardboard blank 110) are thereupon introduced into the receptacles of a rotary wheel-shaped conveyor 113 which comprises and/or cooperates with means for completing the conversion of blanks 110 into outer envelopes of hinged-lid packs 130. The thus obtained packs 130 dwell in the receptacles of the rotary wheel-shaped conveyor 113 for periods of time which are necessary to complete the setting of the adhesive (such as cooling of the hotmelt) so that the packs 130 retain their desired sizes and shapes, i.e., that the parts which are bonded to each other by films of adhesive cannot move relative to each other. As a rule, the adhesive which is utilized in one or more packing units of the improved apparatus is a hotmelt or a cold-bonding adhesive.

The last packing unit of the illustrated apparatus comprises drying columns or shafts 114 wherein the packs 130 remain until advanced to the next apparatus or machine of a production line, e.g., to a machine known as C 90 film wrapper which confines each pack 130 in a transparent film constituting a third or outermost envelope and can be provided with a customary tear strip or tape. The C 90 film wrapper can deliver successive packs to a machine known as B 90 cigarette pack boxer which confines groups of normally ten packs in cardboard boxes known as cartons. The C 90 and B 90 machines are distributed by the assignee of the present application.

The reference characters A to D denote various stations of the improved packing apparatus. Thus, the array forming station A accommodates the assembling unit 100 and its hoppers 101. The station B accommodates the means (105) for supplying and folding blanks (such as precut sheets of metallic foil) which can form the inner envelopes of the packs 130 (i.e., the envelopes of the partially finished packs 106). The station C accommodates the unit or units (such as 108, 109, 111) for the supplying and folding of second blanks 110, and the station D provides room for the packing unit including the wheel-shaped conveyor 113 and the associated means for completing the conversion of blanks 110 into the outer envelopes of the finished packs 130.

The apparatus of FIG. 1 further comprises a primary driving arrangement which includes a single or composite first drive 103. The illustrated drive 103 comprises a first part 120 which transmits motion to a toothed belt 115 and hence to one or more conveyors 115A serving to advance two files of arrays from the station A to the station B. The first drive 103 further serves to transmit motion to mobile constituents of the assembling unit 100 at the; station A. A second part 121 of the first drive 103 transmits motion to the folding members 107, 108 and to other mobile parts at the station C, and a third part 122 of the first drive 103 transmits motion to the wheel-shaped conveyor 113 and to other mobile parts at the station D (FIG. 1 shows that the third part 122 of the first drive 103 transmits motion to the respective driven parts by way of two toothed belts 115*a*, 115*b*). The belt 115*a* receives motion from a transmission 123 which, in turn, receives motion from a rotary output shaft 103A of the first drive 103 and drives a conveyor 115*a'* for the partly finished packs advancing into the range of the wheel-shaped conveyor 113. The belt 115*b* at the station D receives motion from a transmission 124 which is driven by the shaft 103A and drives the conveyor 113.

The apparatus of FIG. 1 further comprises a signal generator 103B which is operatively connected with one or more sensors (not specifically shown) which cause the signal generator 103B to transmit to the first drive a stop signal serving to decelerate and eventually stop the first drive. For example, the signal from the signal generator 103B can be processed at 103B to arrest or to no longer drive the moving parts at the stations A to D upon elapse of two or three successive cycles of the packing operation. Each such cycle includes a first part during which the conveyor 115A is in motion and a second part during which the conveyor 115A is at a standstill.

In accordance with heretofore known proposals, the various units of conventional packing apparatus come to a halt upon completion of a preselected number of cycles following the transmission of a stop signal by the signal generator. Such signal is generated in response to faulty operation of one or more packing units, in response to detection of malfunctioning of one or more makers serving to supply cigarettes to the assembling unit 100, in response to detection of malfunctioning of the machine or machines receiving finished packs 130 from the station D, and/or for any other compelling reason which warrants temporary stoppage of a modern high-speed cigarette packing apparatus.

The just discussed stoppage of all packing units in a standard packing machine or apparatus entails the making of huge quantities of rejects due to the failure of already applied films of adhesive to bond or to adequately bond neighboring parts of the blanks (such as the blanks corresponding to those shown, at 110, in FIG. 1). Moreover, the just described mode of operation of conventional packing apparatus renders it necessary to discard large numbers of blanks which are already provided with films of adhesive but cannot be converted into finished envelopes within two or three cycles following the transmission of a signal (such as a defect signal) by the signal generator(s) of the conventional packing apparatus.

Still further, conventional packing apparatus turn out additional rejects which are constituted by partially finished packs (such as those shown at 106 in FIG. 1) because, when a conventional packing apparatus is restarted (e.g., (upon elimination of the defect(s) of one or more packing units), partially finished packs already located in the path or paths leading from the source (such as 100) of arrays to the outlet of the conventional packing apparatus are brought into contact with blanks carrying already dried or partially dried films of adhesive so that such blanks cannot be converted into satisfactory envelopes. For example, if a blank 110 which carries one or more films of activated adhesive remains on the conveyor 111 for a certain period of time subsequent to the application of adhesive thereto, such blank cannot be converted into an envelope which properly confines the respective partially finished pack 106.

In accordance with the method of the present invention, the numbers of rejects can be reduced to a significant extent in that the improved packing apparatus is provided with a secondary driving arrangement which, in the apparatus of FIG. 1, comprises two second drives 125 and 126. The drive 125 can transmit motion to the transmission 123 and hence to the moving parts driven by the toothed belt 115*a* at the station D. The drive 126 can transmit motion to the transmission 124 and hence to the wheel-shaped conveyor 113 and associated moving parts at the station D (by way of the respective toothed belt 115*b*).

At least one of the second drives 125, 126 can constitute a differential gear (also called differential). These drives cooperate to complete the bonding of various parts of the blanks 110 to each other and to the representative collars 107 (if necessary) prior to setting of adhesive films carried by such blanks. The second drive 125 and/or 126 can be set in operation during the interval of deceleration of the first, drive 103 to zero speed, or during such deceleration and a following interval of idleness of the drive 103, or only during such interval of idleness. This will depend upon the nature of the adhesive coating selected for use on part of the blanks 110 and/or upon the duration of deceleration of the first drive 103 from normal operating speed to zero speed. At any rate, the arrangement is preferably such that those lateral flaps 112 of the blanks 110 which carry films of still active adhesive, or which are to adhere to such films of adhesive, are properly bonded to the neighboring parts of the respecting blanks 110 and the adhesive films have set before the second drive 125 and/or 126 is brought to a halt. For example, the drives 125, 126 can be brought to a halt when the wheel-shaped conveyor 113 is empty, i.e., when all of the packs located downstream of the station B are confined in the drying unit 114.

The transmission 123 can also constitute a differential gear. The control circuit of the improved apparatus can decelerate (disconnect) the transmission 123 prior to renewed starting of the first drive 103, and such control unit can start the second drive 125 to ensure that the, blanks 110 which are advanced by the restarted first drive 103 are already provided with freshly applied adhesive films so that the packing apparatus can turn out satisfactory packs 130 as soon as the first drive 103 is restarted. The interval of operation of the second drive 125 is preferably selected in such a way that the path for the advancement of adhesive-carrying blanks 110 from the paster to the folding members 108, 109 is filled with blanks 110 carrying films of fresh adhesive before the first drive 103 is restarted.

The second drive 125 and/or 126 can be on while the first drive 103 is on, as long as the second drive(s) does or do not interfere with the operation of the packing apparatus prior to generation of a stop signal by the signal generator 103B. It is particularly desirable to ensure that the adhesive applying unit or units be brought to a timely halt in response or subsequent to the generation of a stop signal for the first drive 103, and that such adhesive applying unit(s) be started in good time prior to restarting of the drive 103 (i.e., during the interval of idleness of the conveyor 115A). Thus, it is highly advisable to ensure that those lateral flaps of the blanks 110 which have already advanced beyond the respective adhesive applying unit or units be caused to adhere to the adjacent panels of the outer envelopes (converted blanks 110) prior to stoppage of the packing unit including the folding member 108 and/or 109, as well as that the blanks 110 be set in motion prior to restarting of the first drive 103 to thus ensure that each partly finished pack 106 which comes into contact with a blank 110 upon restarting of the drive 103 will be confined in a blank 110 which carries films of adhesive prior to setting of such adhesive. Otherwise stated, each partly finished pack 106 which is set in motion in response to restarting of the first drive 103 should form part of a satisfactory pack 130.

The above also applies for the wheel-shaped conveyor 113, i.e., this conveyor should be driven (by the second drive 126) until all of the packs in its receptacles can retain their desired shapes at the time of entry into one of the drying units 114.

Thus, the second drives 125, 126 can be set to operate during deceleration of the first drive 103, during deceleration of the drive 103 and during the immediately following period of idleness of the drive 103, and preferably also for a selected period of time preceding restarting of the drive 103.

Though FIG. 1 shows a multiple-track packing apparatus, the invention can be embodied with equal advantage in single-track packing apparatus. An advantage of a multiple-track packing apparatus is that the number of rejects is reduced to a greater extent than in a single-track packing apparatus.

Furthermore, though the packing apparatus of FIG. 1 is set up to operate in stepwise fashion, it is also possible to employ an apparatus wherein the arrays are in continuous motion. An advantage of the illustrated intermittently operated packing apparatus is that the shift from operation with the first drive 103 to operation with the second drive(s) 125 and/or 126 (or vice versa) is simplified.

In accordance with a presently preferred embodiment, the secondary driving arrangement comprises second drives which are designed to operate (when necessary) the blank feeding unit 111, the paster or pasters for the blanks 110, the folding member 108 and/or 109, and/or the conveyor 113. This renders it possible, in a manner as fully described hereinbefore, to complete the application of adhesive films to a requisite number of blanks 110, to complete the assembly of such blanks with the partly finished packs 106, and to evacuate the thus obtained finished packs 130 from the conveyor 113, i.e., into the drying unit 114, after the adhesive sets so that the condition (such as configuration) of the respective finished packs 130 remains unchanged and matches the desired (optimum) configuration.

It is further within the purview of the present invention to expel from the improved packing apparatus those blanks 110 which cannot be converted into satisfactory outer envelopes of finished packs 130. Such blanks can include those blanks which have received films of adhesive paste but cannot be converted into satisfactory outer envelopes of packs 130 subsequent to the generation of a stop signal for the first drive 103. The ejection of selected blanks 110 from the improved packing apparatus can be carried out by resorting to suitable pneumatic ejector(s) which becomes or become active at the time of generation of a stop signal for the first drive 103 or upon elapse of a preselected interval of time following such signal generation.

Still further, it is possible to operate the paster or pasters for the blanks 110 in such a way that a blank which is about to be advanced into the range of the folding member 107 or 108 is provided with a fresh film of adhesive (e.g., over a previously applied and already hardened or set film) prior to conversion of the respective blank into the outer envelope of a finished pack 13.

In accordance with a modification, the second drive 125 can be set in motion in response to the generation of a stop signal for the first drive 103, and such second drive then ensures that at least one of the folding members 107, 108 remains operative during gradual deceleration of the drive 103 and/or during a period of complete stoppage of the drive 103. This ensures the conversion of at least some of the partly finished packs 106 into finished packs 130 with resultant savings in blanks 110 and/or tobacco to be recovered from unsatisfactory packs 130.

Though the utilization of differential gears as second drives 125, 126 and/or as transmissions 120, 121, 122, 123 and/or 124 is preferred at this time, other types of second drives and/or transmissions can be utilized with equal or similar advantage. Differential gears are preferred in many instances because their utilization entails savings in initial cost and contributes to simplicity and reliability of the control unit which is employed in the improved packing apparatus.

An advantage of a secondary driving arrangement which employs a plurality of discrete second drives (such as 125 and 126) is that it is possible to operate such second drives independently of or in synchronism with each other. Substantial savings in blanks 110 and/or a reduction of the number of defective packs 130 can be achieved when the second drive or drives controls or control at least one folding member (107 or 108) and at least one conveyor, for delivery of blanks (such as the conveyor 111 for the blanks 110).

Figure 2:
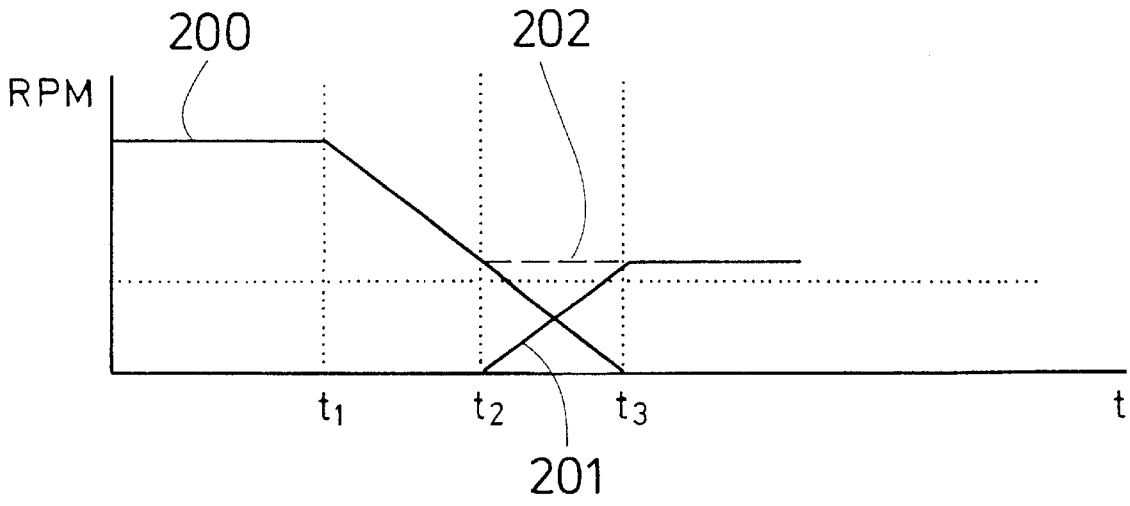
FIG. 2 is a coordinate system wherein the RPMs of rotary members of the first and second drives are measured along the ordinate and the times are measured along the abscissa.

In the coordinate system of FIG. 2, the RPMs of rotary output elements (such as shafts) of the first drive 103 and of the second drive 125 and/or 126 are measured along the ordinate, and the durations of intervals or periods of operation of various drives are measured along the abscissa.

The RPM of the shaft (such as 103A) which receives motion from the first drive 103 is denoted by the curve 200, and the RPM of the output shaft of one of the drives 125, 126 (e.g., of the output shaft 125A of the second drive 125) is denoted by the curve 201. The signal generator 103B transmits a stop signal at the instant t1 and the deceleration of the shaft 103A from maximum or normal RPM to zero RPM takes place during the interval between the instants t1 and t3. The drive 125 is started (e.g., by the signal generator 103B or by the aforementioned control circuit) at the instant t2 and the RPM of its shaft 125A increases from zero to its maximum value at the same rate at which the RPM of the shaft 103A decreases between the instants t2 and t3. The broken line 202 denotes an RPM which is the sum of RPMs of the shafts 103A, 125A during the interval between the instants t2 and t3. Thus, the operation of parts at the station D takes place at a rate which is also denoted by the curve 202, and such operation can proceed beyond the instant t3, i.e., beyond the instant of actual stoppage of the first drive 103.

The second drive 125 and/or 126 is started prior to restarting of the drive 103 and is brought to a halt at the exact moment of restarting the drive 103 or with a preselected delay subsequent to such restarting. The second drive(s) need not be actually arrested, as long as it or they is or are disconnected from the respective transmission 123 and/or 124 in good time for smooth transition from transmission of motion by the second drive 125 and/or 126 to renewed transmission of motion by the first drive 103.

It has been found that the improved packing apparatus and the method which can be practiced by resorting to such apparatus render it possible to greatly reduce the number of rejects (defective packs) and the number of blanks which must be discarded. It is further clear that additional savings can be achieved by providing a (third) second drive for the transmission 122 which drives the folding member 109 (the transmission 122 of such packing apparatus can constitute and preferably constitutes a differential gear). The same applies for the transmission 121 which drives the folding member 108. The provision of a second drive for each of the transmissions 121, 122, 123, 124 entails a pronounced reduction of the number of rejects.

It is advisable to select the normal RPM of the shaft 103A in such a way that it at least equals but can exceed the RPM of the shaft receiving motion from the second drive 125 or 126. This renders it possible to turn out satisfactory packs 130 (with properly glued converted blanks 110) even in the event of a malfunction, e.g., in the event of a malfunction which necessitates the generation (by 103B) of a stop signal for the first drive 103. All that is necessary is to select the RPM of the output element of the second drive 125 and/or 126 in such a way that all adhesive-carrying blanks 110 can be converted into finished outer envelopes of packs 130 prior to setting of adhesive films on such blanks 110. The operation of the control unit (which can be installed in or with the signal generator 103B) for the drives 103, 125, 126 can be selected in such a way that the operations of the first and second drives can be synchronized with a view to ensure that the deceleration of various units of the packing apparatus and the restarting of such units can be carried out in an optimum manner as far as the quality of finished packs 130 and/or the number of rejects is concerned.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of packing machines for cigarettes and other commodities and, therefore, such adaptations should and are intended to be comprehended within the meaning and range of equivalence of the appended claims.

What is claimed is:

1. A method of packing successive arrays of a series of arrays of rod-shaped articles of the tobacco processing industry, comprising the steps of:

employing at least one first drive to carry out a plurality of consecutive packing operations upon each of successive arrays of the series;

generating a signal which entails a deceleration and ensuing stoppage of the at least one first drive; and utilizing at least one second drive to carry out, at least in part, at least one of the packing operations during an interval covering at least one of (a) said deceleration, (b) said deceleration and a period of said ensuing stoppage wherein said second drive is at least one of the packing operations prior to the generation of said signal, and (c) a period of said ensuing stoppage.

2. The method of claim 1, wherein said operations include the steps of advancing successive arrays of said series along a predetermined path and confining each array in at least one envelope in a predetermined portion of said path.

3. The method of claim 2, wherein said advancing step includes moving the arrays stepwise.

4. The method of claim 1, wherein said operations include the steps of advancing successive arrays of the series along a predetermined path, supplying to a portion of said path blanks for conversion into envelopes for successive arrays, applying an adhesive to selected portions of blanks, converting blanks into envelopes surrounding the respective arrays, and withdrawing successive arrays and the respective converted blanks from said path.

5. The method of claim 4, wherein said converting step includes folding the blanks about the respective arrays.

6. The method of claim 1, wherein the second drive further comprises a differential gear and the utilizing step includes utilizing the differential gear.

7. The method of claim 1, wherein said employing step includes resorting to a first drive which is arranged to rotate a first output element at a first RPM prior to said signal generating step, said utilizing step including utilizing at least one second drive which is arranged to rotate a second output element at a second RPM at most matching said first RPM.

8. The method of claim 1, further comprising the step of synchronizing the operation of the first drive with the operation of the at least one second drive.

9. Apparatus for packing successive arrays of a series of arrays of rod-shaped articles of the tobacco processing industry, comprising:

a primary driving arrangement including at least one first drive;

a plurality of mobile packing units receiving motion from said at least one first drive and arranged to provide each of said series of arrays with at least one envelope;

means for generating, at times, signals each of which entails a deceleration and ensuing stoppage of said at least one first drive; and a secondary driving arrangement including at least one second drive arranged to transmit motion to at least one of said packing units during an interval covering at least one of (a) said deceleration, (b) said deceleration and a period of ensuing stoppage, and (c) a period of ensuing stoppage of said at least one first drive wherein said second drive is not driving said at least one of said packing units prior to a signal generated by said means for generating signals.

10. The apparatus of claim 9, wherein the arrays consist of quincunx formations of rod-shaped articles.

11. The apparatus of claim 9, further comprising means for separably coupling said at least one first drive with said at least one second drive.

12. The apparatus of claim 9, wherein said at least one second drive comprises a differential gear.

13. The apparatus of claim 9, wherein said at least one packing unit is one of a plurality of units including means for supplying to successive arrays of said series blanks for conversion into envelopes for the respective arrays, means for applying to selected portions of the blanks an adhesive substance, means for converting blanks into envelopes, and means for evacuating packed arrays.

14. The apparatus of claim 9, wherein said at least one packing unit is one of a plurality of units including means for supplying to successive arrays of said series blanks for conversion into envelopes for the respective arrays, said secondary driving arrangement comprising a plurality of second drives including a drive for said blank supplying means.

15. The apparatus of claim 9, wherein said packing units comprise at least one means for supplying to successive arrays foldable blanks for conversion into envelopes for the respective arrays and folding means operable to drape the blanks around the respective arrays, said at least one second drive including means for operating said folding means.

16. The apparatus of claim 15, wherein said folding means includes at least one rotary folding member.

17. The apparatus of claim 9, wherein said at least one first drive comprises at least one rotary first driving member rotatable at a plurality of speeds and said at least one second drive comprises at least one rotary second driving member rotatable at a plurality of speeds, and further comprising means for synchronizing the speed of said at least one first driving member with the speed of said at least one second driving member.

18. The apparatus of claim 9, further comprising means for assembling rod-shaped articles into said series of arrays.

19. Apparatus for packing successive commodities of a series of successive commodities, comprising:

a primary driving arrangement including at least one first drive;

a plurality of mobile packing units receiving motion from said at least one first drive and arranged to provide each of said series of commodities with at least one envelope;

means for generating, at times, signals each of which entails a deceleration and ensuing stoppage of said at least one first drive; and a secondary driving arrangement including at least one second drive arranged to transmit motion to at least one of said packing units during an interval covering at least one of (a) said deceleration, (b) said deceleration and a period of ensuing stoppage, and (c) a period of ensuing stoppage of said at least one first drive wherein said second drive is not driving said at least one of said packing units prior to a signal generated by said means for generating signals.

20. The apparatus of claim 19, wherein at least one of said packing units includes means for providing the envelopes with films of an adhesive substance.

* * * * *